United States Patent [19]

Wissmann et al.

[11] Patent Number: 4,590,896

[45] Date of Patent: May 27, 1986

[54] TWO-STROKE ENGINE

[75] Inventors: Michael Wissmann, Markgröningen; Harald Schliemann, Waiblingen, both of Fed. Rep. of Germany

[73] Assignee: Andreas Stihl, Waiblingen, Fed. Rep. of Germany

[21] Appl. No.: 704,083

[22] Filed: Feb. 21, 1985

[30] Foreign Application Priority Data

Feb. 21, 1984 [DE] Fed. Rep. of Germany ..... 3406119

[51] Int. Cl.[4] ..... F02B 33/04

[52] U.S. Cl. ..... 123/73 R; 123/378; 123/389; 123/391

[58] Field of Search ..... 123/73 R, 378, 389, 123/391

[56] References Cited

U.S. PATENT DOCUMENTS

| | | | |
|---|---|---|---|
| 2,431,182 | 11/1947 | Mallory | 123/389 |
| 2,627,850 | 2/1953 | Willim | 123/389 |
| 3,999,622 | 12/1976 | Reed | 123/378 |
| 4,323,040 | 4/1982 | Blocki | 123/389 |

*Primary Examiner*—E. Rollins Cross

*Attorney, Agent, or Firm*—Walter Ottesen

[57] ABSTRACT

The invention is directed to a control system for a two-stroke engine for limiting a control quantity thereof such as the rotational speed. For this purpose, a pressure line including a valve is connected to the crankcase and leads to a pneumatic controlling member which is responsive to a mechanical or electrical signal (vibrations or electric pulse from the ignition system). By means of suitable transmission means, the movement of the controlling member is transmitted to the carburetor throttle, for example.

26 Claims, 4 Drawing Figures

TWO-STROKE ENGINE

BACKGROUND OF THE INVENTION

The invention relates to a two-stroke engine equipped with a carburetor controlled by a throttle flap. In two-stroke engines of the above-mentioned type, the reciprocating motion of the piston subjects the crankcase to a continuous change between overpressure and underpressure. The invention is based on the realization that these pressure or oscillation relationships in the crankcase of a two-stroke engine can be made use of, especially by separating the overpressure waves from the underpressure waves in the crankcase, in order to provide a pneumatic auxiliary system for servo functions, in particular for controlling or limiting the engine speed to protect the engine or its parts from overload.

SUMMARY OF THE INVENTION

The two-stroke engine of the invention is equipped with a control device to control an operating condition of the engine such as speed. The two-stroke engine includes: a crankcase subjected to continuously alternating underpressure and overpressure conditions; signal means for providing a signal indicative of a predetermined value of said operating condition of the engine to be controlled; an output actuator connected to the control device of the engine for adjusting said condition; pneumatic actuating means responsive to a change in pressure therein for acting on the output actuator so as to cause the latter to adjust the position of said control device to control said condition; pressure connecting means for connecting the pneumatic actuating means to the crankcase; and, valve means responsive to the signal for acting on the pressure connecting means so as to cause said pressure change to occur in the pneumatic actuating means.

The advantages and essential details of the invention will become apparent from the subsequent description of preferred embodiments, the drawing and the appended claims.

BRIEF DESCRIPTION OF THE DRAWING

The invention will now be described with reference to the drawing wherein.

DESCRIPTION OF THE PREFERRED EMBODIMENTS OF THE INVENTION

Figure 1:
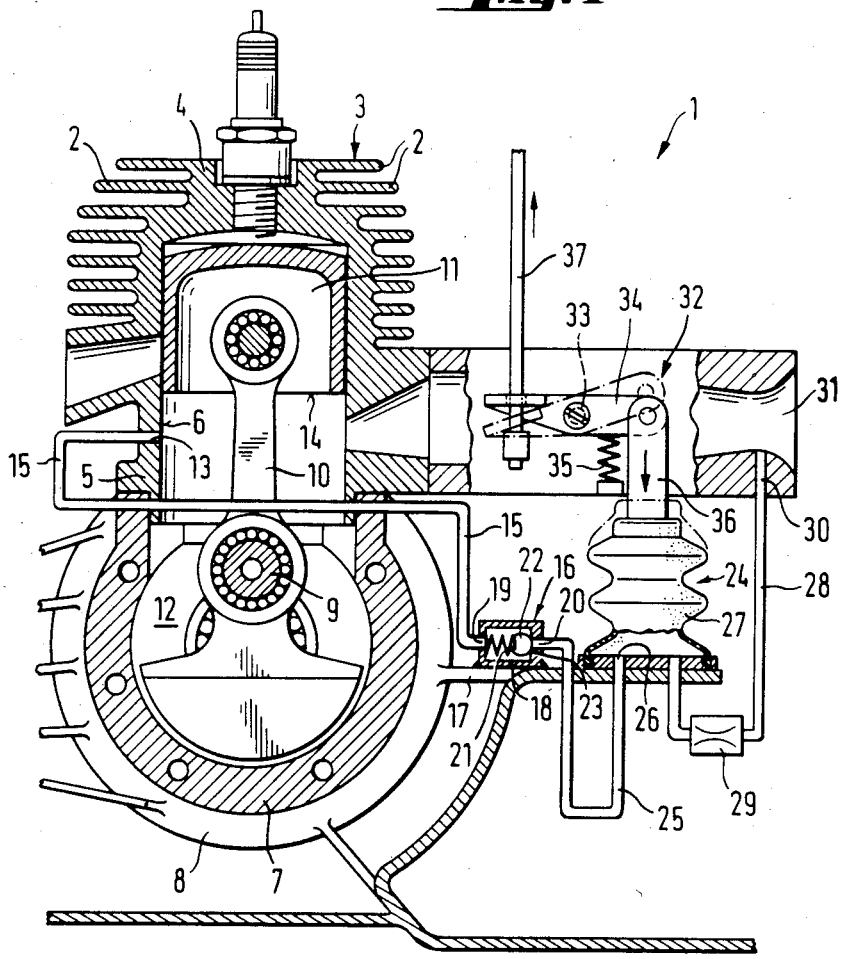
FIG. 1 is a side elevation view, partially in section, of a two-stroke engine with a vacuum-operated speed-control apparatus.

The two-stroke engine 1 illustrated in the drawing includes a cylinder 3 provided with cooling ribs 2. The lower part 5 of the cylinder wall 6 is at the opposite end of the cylinder head 4 and is adjacent to a wall 7 of the crankcase 8. A crankshaft 9 is rotatably journalled in bearings in the crankcase 8 and has a connecting rod 10 and piston 11 assembly pivotally connected thereto.

The piston 11 reciprocates in the cylinder within a predetermined stroke. The piston 11 is shown at top dead center. The reciprocating motion of piston 11 produces different pressure waves in the inner chamber 12 of the crankcase 8, with underpressure alternating with overpressure.

In the embodiment of FIG. 1, a bore 13 is provided in the lower part 5 of the wall 6 of cylinder 3. Bore 13 is positioned such that it is overtraveled by piston 11 as the latter moves towards top dead center in cylinder 3. Thus, the bottom edge 14 of piston 11 is above bore 13 which is thus open and communicates with inner chamber 12 of crankcase 8.

Connected to bore 13 in wall 6 of cylinder 3 is a pressure line 15 which leads to a commercially available vibration valve 16 responsive to speed vibrations of the two-stroke engine 1. A bracket 17 fixedly connects vibration valve 16 with wall 7 of crankcase 8 so that the vibrations of the latter are directly transmitted to vibration valve 16 undampened. When these vibrations reach a predetermined frequency or acceleration amplitude, valve 16 will open as a result of these vibrations.

Vibration valve 16 has a housing 18 with an inlet port 19 and an outlet port 20. Housing 18 accommodates a helical spring 21 bearing against a ball 22. Ball 22 serves as a sealing member and is pressed by spring 21 into sealing engagement with a valve seat 23 disposed at outlet port 20 in the vibration valve 16 of FIGS. 1 and 2. Pressure line 15 is configured as a hollow conduit and is connected to inlet port 19 of housing 18.

Figure 2:
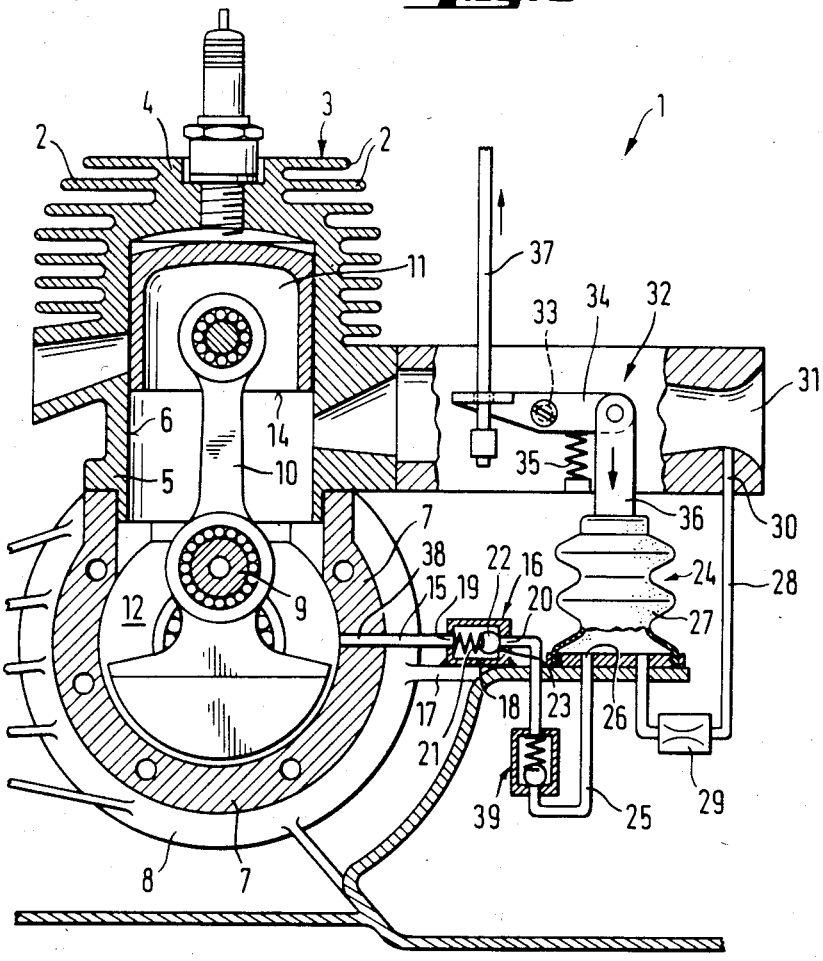
FIG. 2 is also a side elevation view of the two-stroke engine of FIG. 1, showing another embodiment of a vacuum-operated speed-control apparatus.

In the embodiments of FIGS. 1 and 2, a pneumatic controlling member 24 responsive to underpressure is arranged behind vibration valve 16 and is coupled thereto via a control line 25 which connects outlet port 20 of vibration valve 16 with an inlet 26 of pneumatic controlling member 24. In these embodiments, pneumatic controlling member 24 is configured as a bellows 27 which may be made of rubber or plastic material. Instead of the bellows configuration, pneumatic controlling member 24 may also be a piston-and-cylinder assembly in which the piston is axially displaced in the pneumatic cylinder in a known manner when a change in pressure occurs.

In addition, a vent line 28 including an air-flow throttle 29 is provided. Vent line 28 is connected to a transverse bore 30 opening into a carburetor venturi 31. The other end of vent line 28 is connected to control line 25 via bellows 27.

An output actuator 32 is at the end of the bellows 27 of FIGS. 1 and 2 opposite inlet 26. The output actuator 32 is configured as a throttle flap control lever 34 pivotable about an axis 33. Throttle flap control lever 34 coacts with a spring element 35 acting in the opening direction of the throttle flap (not shown) of a carburetor (not shown). One end of throttle flap control lever 34 is pivotally connected to bellows 27 via a connecting lever 36 arranged at substantially right angles to lever 34. A tie rod 37 permitting manual operation of the throttle flap valve is arranged at the other end of throttle flap control lever 34. When tie rod 37 is actuated in the direction of the arrow, the throttle flap will be closed, accompanied by compression of bellows 27. If the tie rod is actuated in a direction opposite to the direction of the arrow, the throttle flap valve will be released and is opened by means of the force of spring 35.

By contrast with the embodiment of FIG. 1, the embodiment of FIG. 2 includes a bore 38 provided in wall 7 of crankcase 8. Hollow line 15 leading to vibration valve 16 is connected to this bore 38 thereby establishing a permanent connection with the inner chamber 12 of crankcase 8 which is independent of the piston stroke. As a result, vibration valve 16 is continuously exposed to the alternating pressure (overpressure and underpressure) occurring in the inner chamber 12 of crankcase 8. To shut off overpressure waves, a rectifier valve 39 is provided which in this embodiment is configured as a spring-loaded ball check valve and arranged in control line 25 downstream of vibration valve 16. It is also possible to arrange rectifier valve 39 upstream of vibration valve 16, thus positioning it in the hollow line 15 between bore 38 of crankcase 8 and inlet port 19 of vibration valve 16.

In the two-stroke engine 1 shown in FIG. 1, a partial vacuum or underpressure exists during the entire time that bore 13 is open so that, with the engine running, a permanent underpressure is built up in conduit 15 leading to vibration valve 16 fixedly secured with crankcase 8. If the speed of the two-stroke engine 1 exceeds the speed to be controlled, the engine housing and consequently the vibration valve 16 will be subjected to such high vibrations that the vibration valve 16 will open. In this event, the valve ball will lift clear of its valve seat 23 which is accomplished because its mass moment of inertia is adjusted to the limit speed (speed limit beyond which the control functions). If the speed to be controlled exceeds this limit, a suitably large acceleration is imparted to the ball, causing it to lift clear of its seat 23 and open the valve. As a result, a connection is established between conduit 15 and control line 25. The underpressure building up in control line 25 will act on bellows 27, causing it to contract and move throttle flap control lever 34 in the closing direction of the throttle flap.

The speed of the two-stroke engine 1 thus throttled will then drop below the limit speed, so that vibration valve 16 will again close. With vibration alve 16 closed, air-flow throttle 29 which is configured so as not to disturb the buildup of underpressure in bellows 27 while vibration valve 16 is open, will then admit air into bellows 27, causing it to expand and to open the throttle flap again. On a time average, the engine will thus be adjusted to the desired control speed. Transverse bore 30 in carburetor venturi 31 is provided for ventilation. As a result, on commencement of the control function when the throttle flap is still open and the underpressure in crankcase 8 is accordingly still low, a pre-underpressure will be present at air-flow throttle 29 because of the high speed of the inducted air in caraburetor venturi 31 under these conditions. This pre-underpressure at air-flow throttle 29 and in vent line 28 assists the formation of underpressure in bellows 27.

In the two-stroke engine 1 illustrated in FIG. 2, the underpressure is produced with aid of rectifier valve 39. Recitifer or check valve 39 charges the control line 25 only with the underpressure waves of crankcase 8. It closes in the presence of overpressure, thus inhibiting the passage of overpressure waves occurring in crankcase 8 to control line 25 and bellows 27. Thus, with a suitable amount of underpressure applied, bellows 27 causes throttle flap control lever 34 to move in the closing direction (direction of arrow on connecting member 36) as in the embodiment previously described.

Figure 3:
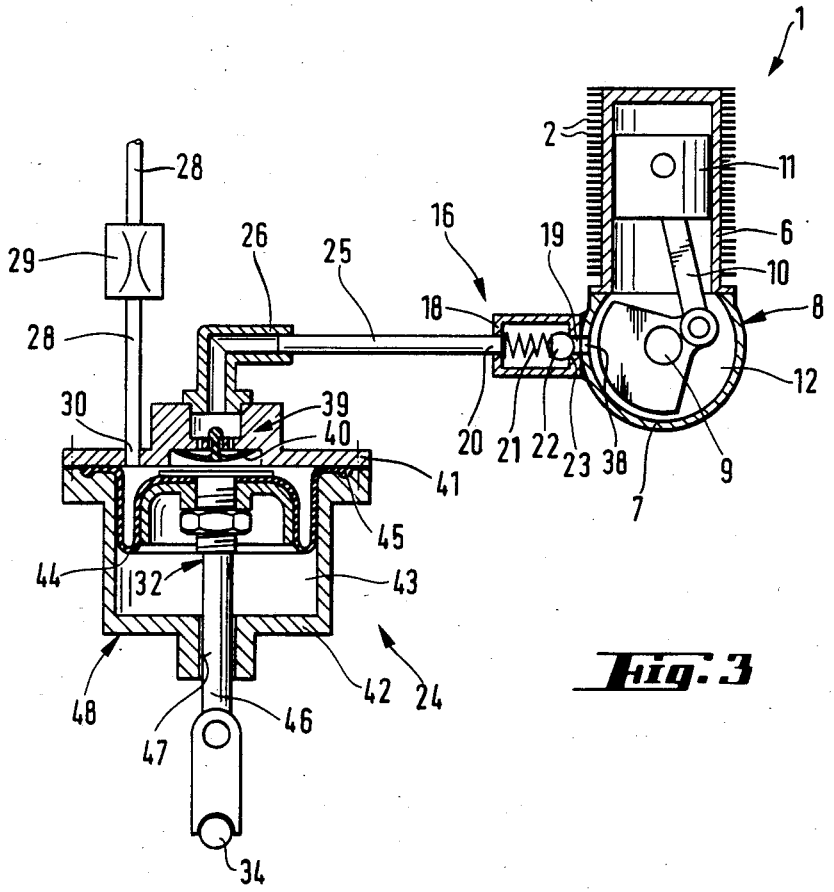
FIG. 3 is a side elevation view of a speed-control apparatus, operable by overpressure of the two-stroke engine similar to FIGS. 1 and 2; and, FIG. 4 is a side elevation view of the two-stroke engine of FIG. 2, with a pneumatic controlling member which, with the engine running, is continuously exposed to vacuum in the direction of full load.

In the embodiment illustrated in FIG. 3 which operates with overpressure, vibration valve 16 is again fixedly secured with the crankcase 8, yet mounted in reverse position. This means that valve seat 23 against which the ball-shaped sealing member 22 rests under the load of spring 21 is disposed at inlet port 19 of housing 18. Thus, helical spring 21 in housing 18 bears with one end against outlet port 20 from which control line 25 extends to mushroom-shaped valve 40 which is configured as a rectifier valve 39. The configuration and arrangement of mushroom valve 40 are such that it opens only in the presence of overpressure waves of crankcase 8.

Mushroom valve 40 is arranged in a cap 41 which seals a cup-shaped housing 42. Chamber 43 of cup-shaped housing 42 accommodates a roll diaphragm 44 the outer circumferential edge 45 of which is clamped seal-tight between cap 41 and the rim of cup-shaped housing 42. For ventilation, a transverse bore 30 is provided in cap 41 and communicates with vent line 28 which includes air-flow throttle 29. A control rod 46 is fastened to roll diaphragm 44 and extends out of a passageway 47 at the end of cup-shaped housing 42 opposite cap 41. Control rod 46 of diaphragm stroke sensor 48 serves to change the position of a throttle flap of the two-stroke engine.

Because, with vibration valve 16 open, rectifier valve 39 allows only the passage of overpressure waves of crankcase 8, the control of the throttle flap via diaphragm stroke sensor 48 is substantially accomplished as in the previously described embodiments; however, the direction is reversed because roll diaphragm 44 will expand in the presence of an overpressure in housing chamber 43, causing the throttle flap to change position in the direction of closing. A bellows or a piston-and-cylinder assembly may be substituted for the roll diaphragm 44. Also, the check or rectifier valve 39 may be arranged either upstream or downstream of vibration valve 16.

The invention thus provides an advantageous control system which, utilizing the pressure waves occurring in crankcase 8, is configured as an auxiliary system for applications requiring control forces, particularly speed governors, whereby a pneumatic pressure is available for servo functions.

In the speed control system described by way of example, vibration valve 16 is opened in dependence on acceleration and consequently in dependence on the rotational speed. In this system, the throttle flap of the carburetor is adjusted in the closing direction so that a closed control loop for speed control is obtained. It is also possible to provide a valve operated by centrifugal force as control valve and arrange the same in the crank web, for example.

The invention affords the significant advantage of avoiding a running up of the two-stroke engine 1 beyond a predetermined speed, even if the fuel is short. Because the control is accomplished by throttling the inducted air-fuel mixture, significant fuel savings can be realized compared to other control methods which are based on enriching the mixture or turning off the ignition.

The invention can also be realized by substituting another valve configuration, for example, a commercially available electropneumatic or solenoid valve, or the like, for the vibration valve 16 described. This valve may receive its opening signal not through mechanical vibrations transmitted via its fastening to the engine housing, particularly to the crankcase or another vibrating part as is the case with the vibration valve, but from the ignition system, for example, particularly an electronic ignition system. This signal may be an electrical signal, such as an electric voltage, issued, for example, by the ignition device at a specific engine speed. The electropneumatic valve or the solenoid valve will then open on receiving this signal, thereby opening the pressure connection between the crankcase and the pneumatic controlling member 24 as described with reference to the embodiment of the vibration valve. This enables the output actuator 32, 46 connected to this pneumatic controlling member 24 to close the carburetor throttle flap when a predetermined speed is attained.

The signal issuing, for example, from the electronics of the ignition system is likewise suitably delivered above the operating speed of the engine so that in a power saw or a cutter, for example, the engine speed is automatically reduced prior to reaching a critical speed and without operator intervention, in order to positively preclude damage to the machine or parts thereof.

Figure 4:
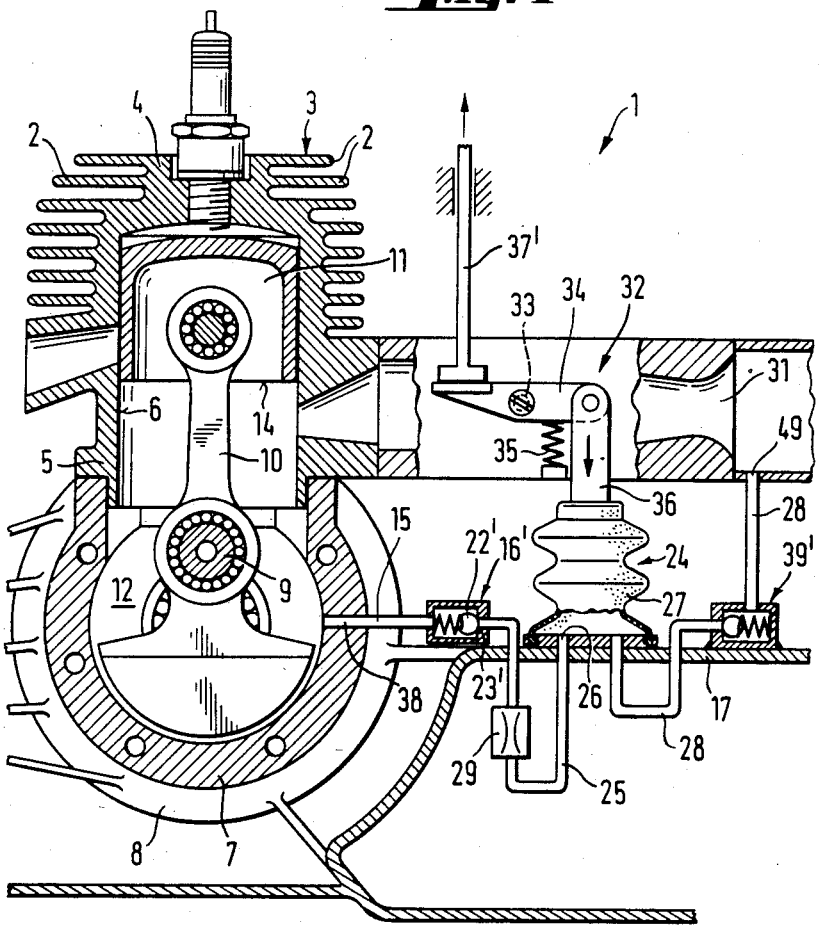

The embodiment illustrated in FIG. 4 corresponds largely to the embodiment of FIG. 2 so that corresponding parts carrying identical reference numerals will not be described again in the following. However, a substantial difference to the embodiments previously described is that, with the engine running, the pneumatic controlling member 24 is continuously exposed to underpressure and that tie rod 37' of output actuator 32 is thereby shifted in the direction of full load as indicated by the arrow above tie rod 37', in opposition to the force of spring 35.

For this purpose, control line 25 connecting inner chamber 12 of crankcase 8 with pneumatic controlling member 24 accommodates a control valve 16' adapted to open only in response to underpressure waves in crankcase 8. This underpressure causes contraction of pneumatic controlling member 24 which is a bellows. Even at high engine speeds, valve 16' is completely independent of, and thus not affected by, the vibrating motions of crankcase 8. Valve 16', which in this embodiment is configured as a ball check valve and may also be a mushroom valve, opens only in the one direction in response to underpressure, while inhibiting passage in the presence of overpressure. For the overpressure condition, the ball-shaped sealing member 22' will engage valve seat 23' as shown. In addition, control line 25 also accommodates air-flow throttle 29 which is arranged between valve 16' and pneumatic controlling member 24.

Moreover, pneumatic controlling member 24 is connected to a control valve 39' for ventilation purposes. Control valve 39' is arranged in vent line 28 which opens into the pneumatic controlling member 24. In this embodiment, intake opening 49 of vent line 28 is in the lower region in front of carburetor venturi 31. Control valve 39' is configured as a spring-loaded ball valve similar to valve 16'; however, the control valve 39' is opened by means of vibrating motions which are dependent on the engine speed. Therefore, control valve 39' is fixedly connected to crankcase 8.

With two-stroke engine 1 running, an underpressure is produced in pneumatic controlling member 24 through pressure line 15, control valve 16' and throttle 29 of control line 25. With control valve 39' in the closed position, pneumatic controlling member 24 is thus continuously exposed to underpressure with the engine running and pulls throttle flap control lever 34 in the direction of full load (arrow) in opposition to the force of spring 35.

When the control speed is reached, control valve 39' will open. This causes the underpressure in pneumatic controlling member 24 to break down, as a result of which the latter is moved in the idling direction (against the direction of the arrow shown on connecting member 36) by spring 35. With the rotational speed decreasing, control valve 39' will again close, and an underpressure will again be built up in the pneumatic controlling member 24, so that output actuator 32 pulls or moves the throttle flap in the direction of full load.

Throttle 29 assists the breakdown of the underpressure with control valve 39' open. The operator opens the throttle flap as a result of tie rod 37' yielding to the pull of pneumatic controlling member 24 at low engine speeds. The throttle flap is closed by expanding the bellows or pneumatic controlling member 24 in opposition to the generally existing underpressure. Instead of a tie rod, a pre-tension spring stronger than spring 35 may be used to close the throttle flap with the bellows in the contacted position, this being accomplished by the spring taking up the length of the closing stroke.

It is a significant advantage of this speed control system that it avoids running up of the two-stroke engine 1 also in the event of a damage to the bellows or pneumatic controlling member 24, the lines, the control apparatus, the control valve 16' or the control valve 39', because in these cases no underpressure is available for opening or adjusting the position of the throttle flap in the direction of full load.

It is understood that the foregoing description is that of the preferred embodiments of the invention and that various changes and modifications may be made thereto without departing from the spirit and scope of the invention as defined in the appended claims.

What is claimed is:

1. A two-stroke engine equipped with a control device to control an operating condition of the engine, the engine comprising:

a crankcase subjected to continuously alternating underpressure and overpressure conditions;

signal means for providing a signal indicative of a predetermined value of the operating condition of the engine to be controlled;

an output actuator connected to said control device for adjusting said operating condition;

pneumatic actuating means responsive to a change in pressure therein for acting on said output actuator so as to cause the latter to adjust said control device to control said operating condition;

pressure connecting means for connecting said pneumatic actuating means to said crankcase; and, valve means responsive to said signal for acting on said pressure connecting means so as to cause said pressure change to occur in said pneumatic actuating means.

2. A two-stroke engine equipped with a carburetor controlled by a throttle flap, the engine comprising:

a crankcase subjected to continuously alternating underpressure and overpressure conditions;

signal means for providing a signal indicative of the rotational speed of the engine to be controlled;

an output actuator connected to said throttle flap of the engine for adjusting the speed thereof;

pneumatic actuating means responsive to a change in pressure therein for acting on said output actuator so as to cause the latter to adjust the position of said throttle flap thereby changing the speed of the engine;

pressure connecting means for connecting said pneumatic actuating means to said crankcase; and, valve means responsive to said signal for acting on said pressure connecting means so as to subject said pneumatic actuating means to one of said pressure conditions thereby causing said pressure change therein.

3. The two-stroke engine of claim 2, the engine having a bore formed in the cylinder wall thereof so as to communicate with the interior of the crankcase, said pressure connecting means being a conduit connecting said crankcase to said pneumatic actuating means; and, said valve means comprising a vibration valve connected into said conduit and rigidly mounted to vibrate with said crankcase; a first portion of said conduit extending from said vibration valve to said crankcase so as to communicate with said bore.

4. The two-stroke engine of claim 3, said bore being located in a lower part of the cylinder wall lying close to said crankcase so as to cause said bore to be uncovered by the lower edge of the piston of the engine when the piston is in the top dead-center region thereby exposing said valve only to said underpressure condition.

5. The two-stroke engine of claim 2, said crankcase having a bore formed therein for communicating with the interior thereof, said pressure connecting means being a conduit connecting said crankcase to said pneumatic actuating means; and, said valve means comprising a vibration valve connected into said conduit and rigidly mounted to vibrate with said crankcase; a first portion of said conduit extending from said vibration valve to said crankcase so as to communicate with said bore.

6. The two-stroke engine of claim 5, comprising a rectifier valve connected into said conduit for blocking the passage of the pressure waves therethrough corresponding to one of said pressure conditions.

7. The two-stroke engine of claim 6, said rectifier valve being a check valve.

8. The two-stroke engine of claim 6, said rectifier valve being a mushroom-type valve.

9. The two-stroke engine of claim 6, said rectifier valve being connected into said first portion of said conduit.

10. The two-stroke engine of claim 6, a second portion of said conduit extending from said vibration valve to said pneumatic actuating means, said rectifier valve being connected into said second portion of said conduit.

11. The two-stroke engine of claim 5, comprising a supporting bracket mounted on the wall of said crankcase, said vibration valve being fixedly mounted on said supporting bracket.

12. The two-stroke engine of claim 5, said vibration valve including a housing having an inlet opening and an outlet opening formed therein and defining a valve seat between said openings; a sealing member; and, a spring for resiliently biasing said sealing member against said valve seat, said sealing member being adapted to lift away from said valve seat against the force of said spring in response to a predetermined frequency of vibration of said crankcase.

13. The two-stroke engine of claim 12, said valve seat being formed at said outlet opening of said housing.

14. The two-stroke engine of claim 12, a second portion of said conduit extending from said outlet of said vibration valve to said pneumatic actuating means, the engine further comprising a rectifier valve connected into said second portion, said rectifier valve being adapted to pass only underpressure waves.

15. The two-stroke engine of claim 12, comprising a rectifier valve adapted for passing only overpressure waves; and, said valve seat and said sealing member being arranged at said inlet opening of said housing.

16. The two-stroke engine of claim 15, said second portion of said conduit leading away from said outlet opening of said vibration valve to said pneumatic actuating means, said pneumatic actuating means being a changeable-length bellows connected to said output actuator.

17. The two-stroke engine of claim 16, said pneumatic actuating means including a chamber-like housing; and, roll diaphragm means mounted in said housing and configured as a membrane stroke sensor.

18. The two-stroke engine of claim 15, said pneumatic actuating means being a cylinder-piston unit connected to said output actuator.

19. The two-stroke engine of claim 2, comprising: vent means connected to said pneumatic actuating means; and, an air-flow throttle for throttling the air flowing through said vent means.

20. The two-stroke engine of claim 19, said vent means comprising: a transverse bore formed in said carburetor so as to communicate with the venturi nozzle thereof; and, an air conduit connecting said transverse bore to said pneumatic actuating means, said air-flow throttle being connected into said air conduit.

21. The two-stroke engine of claim 16, said second portion of said conduit being connected to said changeable-length bellows at one end thereof, said output actuator being connected to said bellows at the other end thereof, said output actuator being connected to a throttle flap lever.

22. The two-stroke engine of claim 21, said output actuator comprising spring means for biasing said throttle flap into the opening direction thereof.

23. The two-stroke engine of claim 22, comprising a tie rod for manually actuating said throttle flap, said output actuator including a simple lever having one end thereof connected to said changeable-length bellows and the other end connected to said tie rod.

24. A two-stroke engine equipped with a carburetor controlled by a throttle flap, the engine comprising:

a crankcase subjected to continuously alternating underpressure and overpressure conditions;

signal means for providing a signal indicative of the rotational speed of the engine to be controlled;

an output actuator connected to said throttle flap of the engine for adjusting the speed thereof;

pneumatic actuating means responsive to a change in pressure therein for acting on said output actuator so as to cause the latter to adjust the position of said throttle flap thereby changing the speed of the engine;

a pressure conduit for connecting said pneumatic actuating means to said crankcase;

check valve means connected into said conduit for passing only waves to said pneumatic actuating means developed by said underpressure condition; and, venting valve means connected to said pneumatic actuating means for responding to said signal to supply air to said pneumatic actuating means so as to cause said pressure change.

25. The two-stroke engine of claim 24, comprising an air-flow throttle connected into said conduit between said check-valve means and said pneumatic actuating means.

26. The two-stroke engine of claim 25, the carburetor having an air-intake tube including a venturi, the engine further comprising air-inlet bore means formed in said air-intake tube ahead of said venturi, said venting valve means including a conduit extending from said air-inlet bore means to said pneumatic actuating means.

* * * * *

UNITED STATES PATENT AND TRADEMARK OFFICE

CERTIFICATE OF CORRECTION

PATENT NO. : 4,590,896

DATED : May 27, 1986

INVENTOR(S) : Michael Wissmann and Harald Schliemann

It is certified that error appears in the above-identified patent and that said Letters Patent is hereby corrected as shown below:

In column 3, line 42: delete "vibration alve" and substitute -- vibration valve -- therefor.

In column 6, line 22: delete "contacted" and substitute -- contracted -- therefor.

Signed and Sealed this

*Twelfth* Day of *August 1986*

[SEAL]

*Attest:*

DONALD J. QUIGG

*Attesting Officer*

*Commissioner of Patents and Trademarks*